US007642966B2

(12) United States Patent
Vance

(10) Patent No.: US 7,642,966 B2
(45) Date of Patent: Jan. 5, 2010

(54) CARRIER AND DEVICE

(75) Inventor: Scott Vance, Staffanstorp (SE)

(73) Assignee: Sony Ericsson Mobile Communications AB, Lund (SE)

( * ) Notice: Subject to any disclaimer, the term of this patent is extended or adjusted under 35 U.S.C. 154(b) by 11 days.

(21) Appl. No.: 12/048,889

(22) Filed: Mar. 14, 2008

(65) Prior Publication Data

US 2009/0231199 A1 Sep. 17, 2009

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,683,576 | B2 * | 1/2004 | Achim | 343/702 |
| 7,061,430 | B2 * | 6/2006 | Zheng et al. | 343/700 MS |
| 7,113,133 | B2 * | 9/2006 | Chen et al. | 343/700 MS |
| 2004/0196187 | A1 | 10/2004 | Yeh | |
| 2006/0139214 | A1 | 6/2006 | Deng et al. | |
| 2007/0115177 | A1 | 5/2007 | Kawahata et al. | |
| 2007/0205949 | A1 * | 9/2007 | Enoshima et al. | 343/702 |
| 2008/0122713 | A1 * | 5/2008 | Chang et al. | 343/745 |

FOREIGN PATENT DOCUMENTS

| | | |
|---|---|---|
| EP | 1 113 524 A2 | 7/2001 |
| JP | 2006-246070 | 9/2006 |
| WO | WO 2006/070233 A1 | 7/2006 |

OTHER PUBLICATIONS

International Search Report and Written Opinion issued in corresponding international application No. PCT/EP2008/061138 mailed on Nov. 14, 2008, 14 pages.

* cited by examiner

*Primary Examiner*—Tan Ho
(74) *Attorney, Agent, or Firm*—Harrity & Harrity, LLP

(57) ABSTRACT

A carrier that extends in three mutually orthogonal directions, X, Y and Z, when in use and which comprises a back surface defining a first XY-plane and a side surface defining an XZ-plane, whereby the carrier comprises an antenna pattern. The antenna pattern comprises a wider branch that is located on the back surface of the carrier, and a narrower branch that comprises a first section that extends substantially along the Z-direction of the side surface and a second section that extends substantially in the X-direction of the side surface.

20 Claims, 3 Drawing Sheets

CARRIER AND DEVICE

FIELD OF THE INVENTION

The present invention relates to a carrier comprising an antenna pattern and a device comprising such a carrier.

BACKGROUND OF THE INVENTION

An antenna is a transducer designed to transmit and/or receive radio, television, microwave, telephone and radar signals, i.e. an antenna converts electrical currents of a particular frequency into electromagnetic waves and vice versa. Physically, an antenna is an arrangement of one or more electrical conductors that is arranged to generate a radiating electromagnetic field in response to an applied alternating voltage and the associated alternating electric current, or that can be placed in an electromagnetic field so that the field will induce an alternating current in the antenna and a voltage between its terminals.

Portable wireless communication electronic devices, such as mobile phones, typically include an antenna that is connected to electrically conducting tracks or contacts on a printed circuit board by soldering or welding. Manufacturers of such electronic devices are under constant pressure to reduce the physical size, weight and cost of the devices and improve their electrical performance. This low cost requirement dictates that the electronic device and its antenna should be simple and inexpensive to manufacture and assemble.

A further challenge facing manufacturers is to provide electronic devices with a compact, high gain, multi-band antenna i.e. an antenna capable of simultaneously transmitting and/or receiving signals using different wireless communication standards, such as GPS, Rx diversity, W-LAN, Wi-Fi, Bluetooth and UWB, with a good front to back ratio.

The front to back ratio of an antenna (which is usually expressed in dB,) is defined as the gain of the antenna in a specified direction, usually that of maximum gain, compared to the gain in a direction 180° from the specified direction. The front to back ratio is normally defined as the ratio of radiation, away from the user's head compared with the ratio of radiation towards the user's head. An antenna which radiates as much towards the user's head as away from it (when a user is holding a call phone containing the antenna in talking position) is said to have a 0 dB front to back ratio. An antenna which radiates 1 dB more away from the user's head than towards the user's head is said to have a 1 dB front to back ratio. The higher this ratio the better the talking performance of a mobile phone containing the antenna.

It has been found that many conventional antennas, when placed at the bottom of a stick type mobile telephone over a ground plane, have a front to back ratio of approximately 0 dB. It is also well known that planar inverted F antennas (PIFAs) over a ground plane can be used to improve the front to back ratio. It is however also well known that PIFA antennas have narrow low-band bandwidth and that it is difficult to achieve good performance in the 850 and 900 MHz GSM bands if the antenna occupies small volume.

SUMMARY OF THE INVENTION

An aspect of the present invention is to provide an improved antenna.

This aspect is achieved by a carrier that extends in three mutually orthogonal directions, X, Y and Z when in use and which comprises a back surface defining an XY-plane and a side surface defining an XZ-plane. The carrier comprises an antenna pattern that comprises a wider branch that is located on the back surface of the carrier, and a narrower branch that comprises a first section that extends substantially along the Z-direction of the side surface, i.e. the narrower branch has a certain offset in the Z-direction relative to the wider branch, and a second section that extends substantially in the X-direction of the side surface. The carrier is arranged to be mounted on/in a printed circuit board (PCB) or on/in a device, or alternatively, the carrier may itself be a PCB, i.e. whereby the antenna pattern is provided directly on/in a PCB.

The present invention also concerns a device, such as a portable electronic device, which comprises a carrier according to any of the embodiments of the invention. According to an embodiment of the invention the device comprises a user interface front side (the LCD side of a mobile telephone for example) and a rear side, whereby the back surface of the carrier is arranged closest to the rear side of the device.

The expression "when in use" is intended to mean that an antenna pattern may be provided on a substantially flat carrier which is arranged to be formed so that the carrier extends in three mutually orthogonal directions, X, Y and Z, when the antenna constituted at least in part by the carrier's antenna pattern is ready for use, or in use, i.e. when the carrier is mounted on/in a PCB, or in a device, by bending the carrier into the desired shape for example.

This antenna pattern described above constitutes part of a high gain multi-band branched monopole or semi-PIFA antenna with good talking performance. The position of the wider branch and the narrower branch relative to one another namely result in an antenna having good directivity in the high bands (such as 1710-2170 MHz), such as DCS, PCS and UMTS band 1, 2, which results in lower emissions towards a user's head in high-bands, where the directivity of an antenna measures the power density an antenna radiates in the direction of its strongest emission, relative to the power density radiated by an ideal isotropic radiator antenna radiating the same amount of total power. A front to back ratio of at least 1 dB can consequently be obtained.

Furthermore, the antenna is ground free so it functions as a monopole antenna in the low bands (such as 824-960 MHz) and significant bandwidth can be achieved even if the antenna occupies a small volume. The antenna is easy to tune to a desired frequency band and it is simple and inexpensive to manufacture. The antenna also provides good isolation between the narrower branch and the wider branch (i.e. there is very little capacitive coupling between the narrower branch and the wider branch).

The expression carrier and as used in this document is intended to mean any flexible or non-flexible, planar or non-planar, substantially non-electrically-conductive substrate that is used to mechanically support an antenna pattern. The carrier may be a printed circuit board, or PCB (also called a printed wiring board (PWB)), whereby it also comprises at least one microchip or other electronic component, and/or electrically connects components supported thereon and/or connected thereto using conductive pathways etched, printed, engraved, or otherwise provided thereon.

The carrier may be any dielectric substrate having a relative dielectric constant ($\epsilon_r$) greater than one and may for example comprise a PTFR (polytetrafluoroethylene)/fibreglass composite or any other suitable dielectric material having a relative dielectric constant ($\epsilon_r$) up to twenty or more. An antenna pattern may be provided on/inside a carrier, a PCB or a device using, for example, a lithographic technique.

It should be noted that an antenna pattern provided on/in a carrier or device according to the present invention may be arranged to have at least one more additional branch extending in any desired direction apart from a wider branch and a narrow branch.

According to an embodiment of the invention the length of the second section of the narrower branch is at least about 40% longer than the length of the first section of the narrower branch, preferably at least about 50% longer and more preferably at least about 60% longer. This ensures that the bulk of the narrower branch extends substantially in the X-direction of said side surface and is thereby located closer to the user's head than the wider branch when the carrier is placed in a device with its back surface arranged closest to the rear side of the device.

According to an embodiment of the invention the narrower branch is about 0.5 to about 2.5 mm wide, preferably about 1.0 to about 2.0 mm wide, and more preferably about 1.5 mm wide.

According to another embodiment of the invention the wider branch is at least about 4 mm wide, preferably at least about 8 mm wide, more preferably at least about 10 mm wide and even more preferably at least about 12 mm wide. The wider the wider branch the better although the width of the wider branch will be constrained by the design and geometry of the carrier/PCB/device.

According to a further embodiment of the invention the first section of the narrower branch has a length of at least about 4 mm so as not to adversely affect the directivity of the antenna, preferably about 5 to about 7 mm and more preferably about 5.5 mm.

According to an embodiment of the invention the first section of the narrower branch is arranged to extend substantially along an edge of the side surface. According to an embodiment of the invention the second section of the narrower branch is arranged to extend substantially along the edge of the side surface which is furthest from the back surface.

According to another embodiment of the invention the antenna pattern comprises a feed point for connecting the antenna pattern to a feed line (i.e. a medium for conveying signal energy from a signal source to the antenna pattern). The carrier may comprise a ground point and circuitry for connecting the antenna pattern to ground via a capacitive and/or inductive coupling, i.e. an LC load, to enable the antenna pattern to realize a particular resonant frequency and consequently transmit signals within a particular frequency band when the antenna pattern is in use.

According to a further embodiment of the invention the wider branch and the narrower branch extend from a common point and the common point is located at a distance corresponding to about 30 to about 50% of the total length of the antenna pattern as measured from the antenna pattern's feed point to the common feed point and then to a distal end of the narrower branch (i.e. the total length of the antenna pattern is equal to the length of the narrower branch). There is therefore a significant length of antenna prior to the narrower branch and the wider branch branching away from each other.

The narrower branch may have a total length (as measured along the narrower branch from the feed point via the common point to a distal end of the narrower branch) that is at least about 30% longer than the total length of the wider branch (as measured along the wider branch from the common point to a distal end of the wider branch), preferably at least about 40% longer and more preferably at least about 50% longer. The longer narrower branch constitutes a high impedance area which serves to improve the bandwidth of the high band.

According to an embodiment of the invention the antenna pattern comprises a parasitic element to improve the high bandwidth, gain and matching of the antenna constituted in part by the antenna pattern. The parasitic element may have a width of about 0.2 to about 0.6 mm, preferably of about 0.3 to about 0.5 mm, more preferably of about 0.4 mm. Wider parasitic elements up to about 3 to about 4 mm in width may also be used, but generally result in reduced gain. The parasitic element may be located on the back surface and it may extend substantially in the X-direction thereof.

According to another embodiment of the invention a distal end of the wider branch is located within about 20 mm of a distal end of the narrower branch (measured as the shortest distance between the distal ends), preferably within about 10 mm.

The device according to the present invention is for example a mobile telephone, such as a clamshell or stick-type telephone. The present invention may however concern any portable or non-portable device such as a media player, Personal Communications System (PCS) terminal, Personal Data Assistant (PDA), laptop computer, palmtop receiver, camera, television, radar or any appliance that includes a transducer designed to transmit and/or receive radio, television, microwave, telephone and/or radar signals. The carrier according to the present invention is however intended for use particularly, but not exclusively, for high frequency radio equipment.

BRIEF DESCRIPTION OF THE DRAWINGS

The accompanying drawings, which are incorporated in and constitute part of the specification, illustrate embodiments of the invention and together with the description, explain the invention. In the drawings.

It should be noted that the drawings have not necessarily been drawn to scale and that the dimensions of certain features may have been exaggerated for the sake of clarity.

DETAILED DESCRIPTION OF EMBODIMENTS

The following detailed description refers to the accompanying drawings. The detailed description does not limit the invention. Instead, the scope of the invention is defined by the appended claims and equivalents.

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 10 percent up or down (higher or lower).

Figure 1:
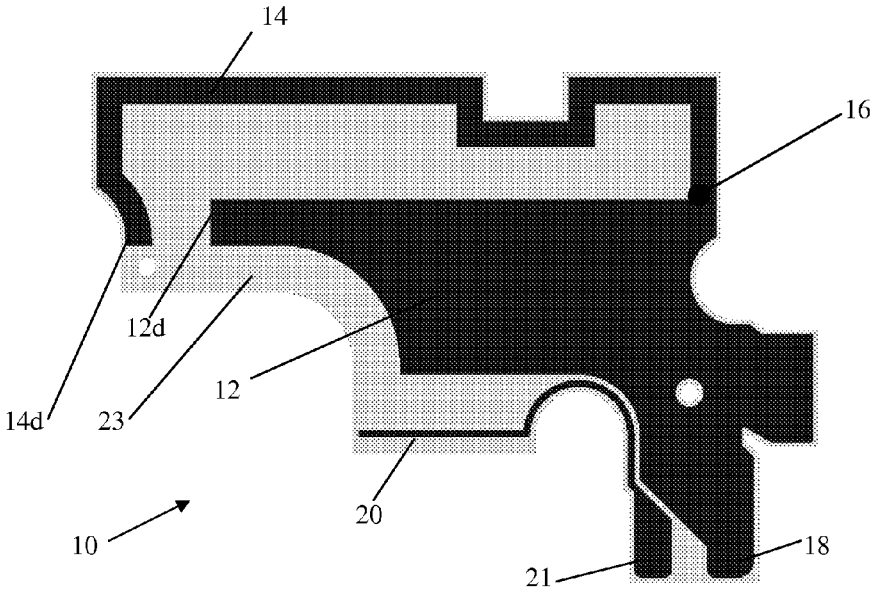
FIG. 1 shows an antenna pattern according to an embodiment of the invention.

FIG. 1 shows a flat antenna pattern 10 (represented by the darker color in FIG. 1) according to an embodiment of the invention. The antenna pattern 10 comprises a shorter wider branch 12 and a longer narrower branch 14. The shorter wider branch 12 and the longer narrower branch 14 extend from a common point 16. The antenna pattern 10 comprises a feed point 18, and a thin parasitic element 20 to improve the high bandwidth, gain and matching of the antenna pattern 10. The parasitic element 20 is connected to a ground point on a carrier/PCB/device via a grounding point 21.

The longer narrower branch 14 is about 0.5 to about 2.5 mm wide, preferably about 1.0 to about 2.0 mm wide, and more preferably about 1.5 mm wide. The wider branch is at least about 4 mm wide, preferably at least about 8 mm wide, preferably at least about 10 mm wide and more preferably at least about 12 mm wide.

The common point 16 is located at a distance corresponding to about 30 to about 50% of the total length of the antenna pattern 10, i.e. the distance from the antenna pattern's feed point 18 to a distal end 14*d* of the narrower branch 14 measured from the feed point 18 to the common point 16 and then along the narrower branch 14 of the antenna pattern 10.

According to an embodiment of the invention the narrower branch 14 has a total length (as measured from the feed point 18 via the common point 16 to a distal end 14*d* of the narrower branch) that is at least about 30% longer than the total length of the wider branch 12 (as measured from the common point 18 to a distal end 12*d* of the wider branch 12), preferably at least about 40% longer and more preferably at least about 50% longer.

Figure 2A:
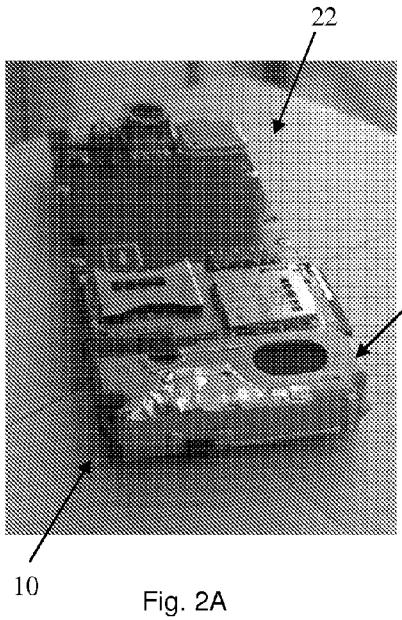
FIG. 2A shows a photograph of a printed circuit board for a mobile telephone comprising a carrier according to an embodiment of the invention.
Figure 2B:
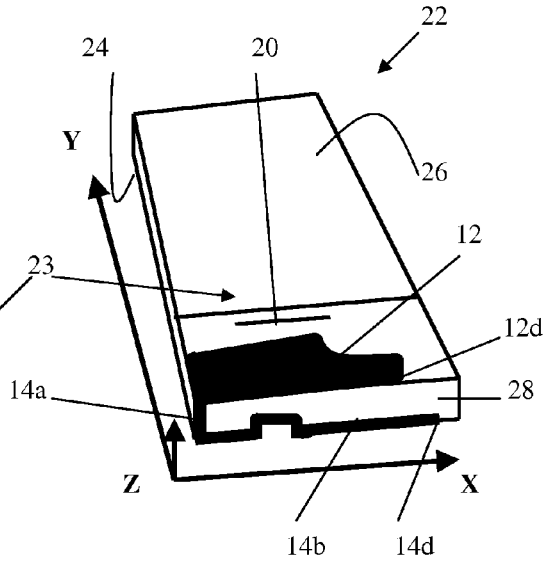
FIG. 2B shows a schematic drawing of a printed circuit board for a mobile telephone comprising a carrier according to an embodiment of the invention.

FIG. 2 shows a photograph and a schematic drawing of a printed circuit board (PCB) 22 comprising a carrier 23 according to an embodiment of the invention. The flat antenna pattern 10 illustrated in FIG. 1 has namely been wrapped around the outer surface of a non-planar plastic/ceramic carrier 23, which has then been mounted on a PCB 22, thereby decreasing the volume of the antenna constituted in part by the antenna pattern 10. Alternatively, an antenna pattern 10 may be provided on/in a substantially flat carrier 23 which is then formed into the required shape. Furthermore, the antenna pattern 10 could be provided directly on/in the PCB 22.

The PCB 22 extends in three mutually orthogonal directions, X, Y and Z and comprises a front surface 24 defining a first XY-plane, a back surface 26 defining a second XY-plane, and a side surface 28 defining an XZ-plane, which extends between the front surface 24 and the back surface 26.

Once the carrier 23 has been mounted on the PCB 22, the wider branch 12 of the antenna pattern 10 is located on the back surface 26 of the PCB 22. The narrower branch 14 of the antenna pattern 10 comprises a first section 14*a* that extends substantially along an edge of the side surface 28, in the Z-direction of the side surface 28 and a second section 14*b* that extends substantially in the X-direction of the side surface 28. The second section 14*b* of the narrower branch 14 is arranged to extend substantially along the edge of the side surface 28 which is closest to the front surface 26 of the PCB 22. In the illustrated embodiment there is a slight meander in the second section 14*b* of the narrower branch 14, which allows the antenna pattern 10 to accommodate an opening for a microphone port. However, the second section 14*b* of the narrower branch need not necessarily meander in this way. The first section 14*a* of the narrower branch 14 has a length of at least about 4 mm, preferably about 5 to about 7 mm and more preferably about 5.5 mm. The spacing or gap between the second section 14*b* of the narrower branch 14 and the wider branch 12 is at least about 2 mm, preferably in the range of about 4 to about 10 mm.

The distal end 12*d* of the wider branch 12 is located within about 20 mm of the distal end 14*d* of said narrower branch 14 (measured as the shortest distance between the distal ends 12*d* and 14*d*), preferably within about 10 mm.

The parasitic element 20 of the antenna pattern 10 has a width of about 0.2 to about 0.6 mm, preferably of about 0.3 about 0.5 mm, more preferably of about 0.4 mm, it is located on the back surface 26 of the PCB 22 and extends substantially in the X-direction thereof.

The wider branch 12, narrower branch 14 and parasitic element 20 of the antenna pattern 10 are for example provided by depositing/bonding continuous electrically conducting layers, such as, for example, a metal, onto the carrier 23.

Figure 3:
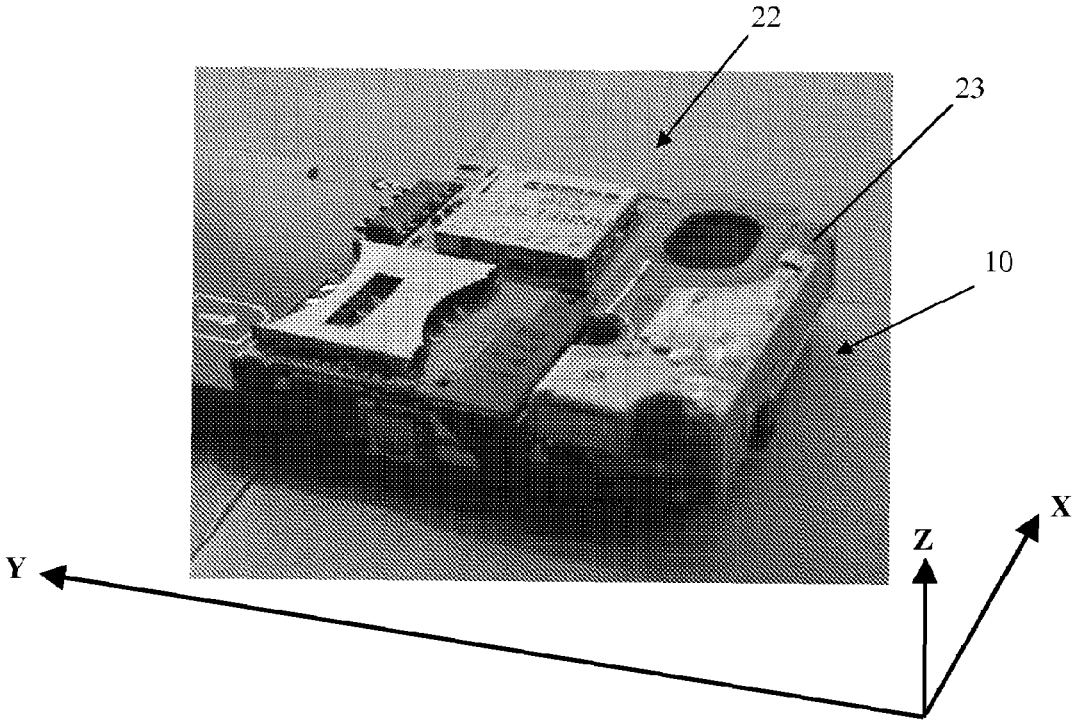
FIG. 3 shows a photograph of the printed circuit board shown in FIG. 2 taken from a different angle, FIG. 4 schematically shows a device according to an embodiment of the invention, and FIG. 5 schematically shows a cross section through the bottom of a device containing a printed circuit board according to an embodiment of the invention.

FIG. 3 shows a photograph of the printed circuit board 22 illustrated in FIG. 2 taken from a different angle.

Figure 4:
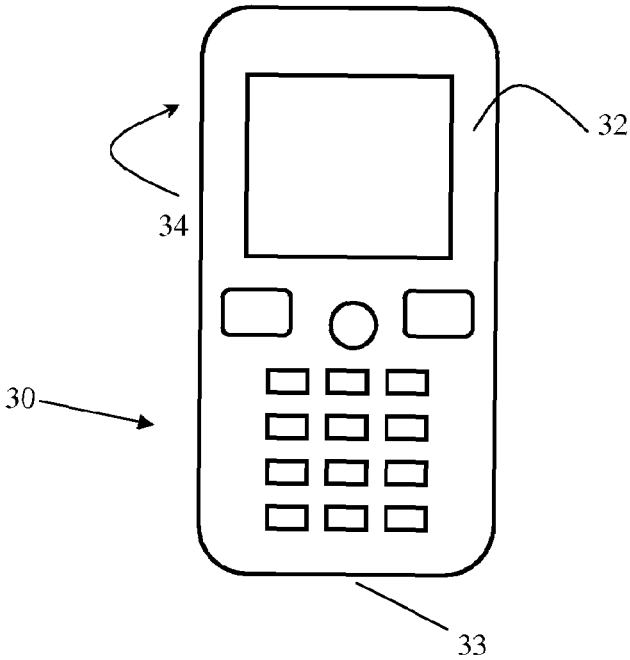

FIG. 4 shows a device 30 according to an embodiment of the invention, namely a portable stick-type telephone. The device 30 comprises a PCB such as the one illustrated in FIGS. 2 and 3. The device comprises a user interface front side 32 on which side the user's head will be located when he/she is making a telephone call. The device also comprises a rear side 34, which is the side furthest away from a user's head located when he/she is making a telephone call.

It should be noted that when the antenna pattern 10 according to any of the embodiments of the invention is included in a small portable radio communication device, such as a mobile phone, it only partly contributes to the transmission or reception of the radio waves transmitted or received by the device. Other large, electrically conductive components of the device, such as its chassis, its battery or a printed circuit board also influence the transmission and/or reception of radio signals. The antenna pattern 10 is capacitively and/or inductively coupled to these mass blocks in such a way that the complete antenna (i.e. the antenna pattern 10 and the mass blocks) is provided with the desired impedance.

Figure 5:
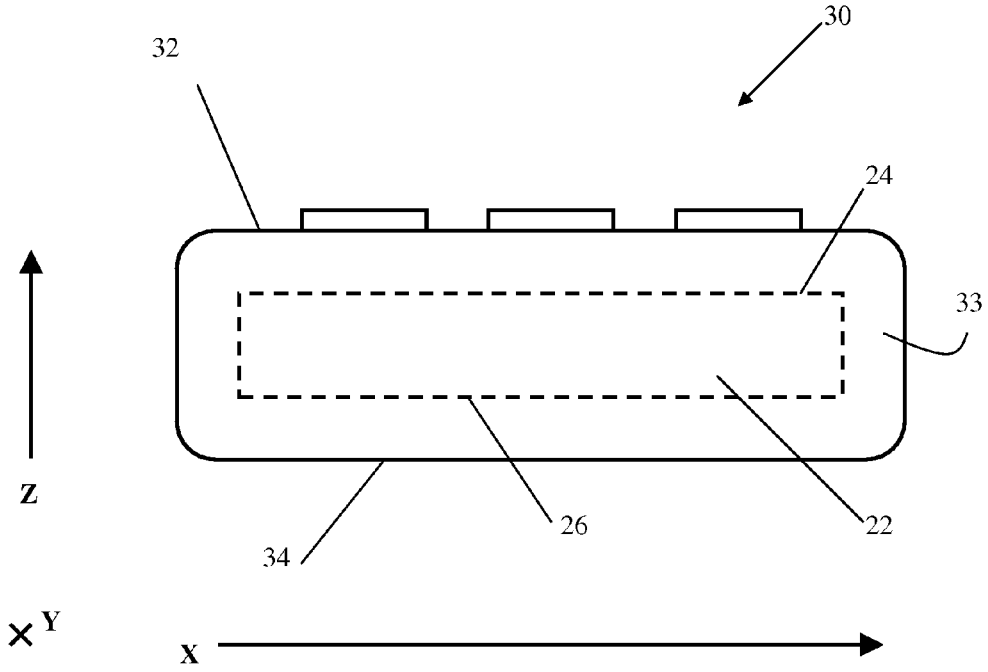

FIG. 5 schematically shows a cross section through the bottom of the device 30 illustrated in FIG. 4, viewed along the Y-axis i.e. along the longitudinal axis of the device 30. The device 30 contains the PCB 22 illustrated in FIGS. 2 and 3, the front surface 24 of which arranged closest to the user interface front side 32 of the device 30 and the back surface 26 of which is arranged closest to the rear side 34 of the device 30. The side surface 28 of the PCB 22 is arranged at the bottom side 33 of the device 30, i.e. the lowermost side of the device 30 when the device 30 is being held by a user who is using the device 30. The wider branch 12 of the antenna pattern 10 will therefore be located at the rear side 34 of the device 30 away from a user's head when a user is using the device 30 to make a telephone call.

The narrower branch 14 of the antenna pattern 10 shown in FIGS. 1-3 has a phase offset relative to the wider high-band branch 12 in the high-band. By positioning the branches 12 and 14 as shown in FIGS. 2, 3 and 5 (i.e. the narrower branch 14 closer to the user's head and the shorter wider branch 12 further from the user's head), a front to back ratio higher than conventional designs can be achieved. In the embodiment shown in FIGS. 2 and 3, a front to back ratio of 1.8 dB in the high-bands was achieved. This is an improvement of about 1.3 dB relative to known designs.

Measurements have shown that the increase in front to back ratio is reflected in lower emissions from the user interface front side 32 of the device (i.e. lower E and H fields).

Further modifications of the invention within the scope of the claims would be apparent to a skilled person. It should for example be noted that the antenna pattern described in this document, which is mechanically supported by a carrier, could of course be replaced with a self-supporting antenna structure that does not require a carrier. A self-supporting antenna comprising a wider branch and a narrower branch that are positioned as described in this document is therefore also considered to lie within the scope of the invention.

What is claimed is:

1. A carrier that extends in three mutually orthogonal directions, X, Y and Z, when in use, and which comprises:

a back surface defining a first XY-plane;

a side surface defining an XZ-plane; and an antenna pattern, where the antenna pattern comprises:

a wider branch that is located on the back surface of the carrier;

a narrower branch that comprises a first section that extends substantially along the Z-direction of the side surface and a second section that extends substantially in the X-direction of the side surface; and where the wider branch and the narrower branch extend from a non-grounded common point and where the narrower branch is non-grounded along its length.

2. A carrier according to claim 1, where the second section of the narrower branch has a length that is at least about 40% longer than the length of the first section of the narrower branch.

3. A carrier according to claim 1, where the narrower branch is about 0.5 to about 2.5 mm wide.

4. A carrier according to claim 1, where the wider branch is at least about 4 mm wide.

5. A carrier according to claim 1, where the first section of the narrower branch has a length of at least about 4 mm.

6. A carrier according to claim 1, where the first section of the narrower branch is arranged to extend substantially along an edge of the side surface.

7. A carrier according to claim 1, where the second section of the narrower branch is arranged to extend substantially along the edge of the side surface which is furthest from the back surface.

8. A carrier according to claim 1, where the wider branch and the narrower branch extend from a common point and the common point is located at a distance corresponding to about 30 to about 50% of the total length of the antenna pattern as measured from the antenna pattern's feed point to a distal end of the narrower branch via the common point.

9. A carrier according to claim 8, where the narrower branch has a total length, as measured from the feed point via the common point to a distal end of the narrower branch, that is at least about 30% longer than the total length of the wider branch, as measured from the common point to a distal end of the wider branch.

10. A carrier according to claim 1, where the antenna pattern comprises a parasitic element to improve the high bandwidth, gain and matching of the antenna pattern.

11. A carrier according to claim 10, where the parasitic element has a width of about 0.2 to about 0.6 mm.

12. A carrier according to claim 10, where the parasitic element is located on the back surface and extends substantially in the X-direction thereof.

13. A carrier according to claim 1, where a distal end of the wider branch is located within about 20 mm of a distal end of the narrower branch, measured as a shortest distance between the distal end of the wider branch and the distal end of the narrower branch.

14. A carrier according to claim 1, where the carrier is arranged to be mounted on/in a printed circuit board (PCB) or on/in a device.

15. A carrier according to claim 1, where the carrier is a printed circuit board (PCB).

16. A portable electronic device comprising:

a carrier that extends in three mutually orthogonal directions, X, Y and Z, when in use, and which comprises:

a back surface defining a first XY-plane;

a side surface defining an XZ-plane; and an antenna pattern, where the antenna pattern comprises:

a wider branch that is located on the back surface of the carrier; and a narrower branch that comprises a first section that extends substantially along the Z-direction of the side surface and a second section that extends substantially in the X-direction of the side surface; and where the wider branch and the narrower branch extend from a non-grounded common point and where the narrower branch is non-grounded along its length.

17. A portable electronic device according to claim 16, further comprising a user interface front side and a rear side, where the back surface of the carrier is arranged closest to the rear side of the device.

18. A portable electronic device according to claim 16, where the device comprises a mobile telephone.

19. A portable electronic device according to claim 18, where the mobile telephone comprises at least one of a clamshell mobile telephone or a stick-type mobile telephone.

20. A device comprising an antenna pattern, where the antenna pattern comprises:

a feed point;

a wider branch extending from a non-grounded common point; and a narrower branch extending from the non-grounded common point, where the narrower branch comprises:

a first section that extends substantially along a Z-direction, a second section that extends substantially along an X-direction, where the second section is at least about 40% longer than the length of the first section, where the narrower branch has a total length, as measured from the feed point via the common point to a distal end of the narrower branch that is at least about 30% longer than the total length of the wider branch, as measured from the common point to a distal end of the wider branch; and where the narrower branch is non-grounded along its length.

* * * * *